US010345033B1

(12) United States Patent
Thomas et al.

(10) Patent No.: US 10,345,033 B1
(45) Date of Patent: Jul. 9, 2019

(54) DISPENSING ASSEMBLY FOR A REFRIGERATOR APPLIANCE

(71) Applicant: Haier US Appliance Solutions, Inc., Wilmington, DE (US)

(72) Inventors: Ryan Joseph Thomas, Louisville, KY (US); Katherine Michelle Jansen, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/897,207

(22) Filed: Feb. 15, 2018

(51) Int. Cl.
*F25D 23/12* (2006.01)

(52) U.S. Cl.
CPC ..... *F25D 23/126* (2013.01); *F25D 2323/122* (2013.01); *F25D 2331/806* (2013.01)

(58) Field of Classification Search
CPC ..... F25D 23/126; F25D 2331/806; F25D 2323/122
See application file for complete search history.

(56) References Cited

U.S. PATENT DOCUMENTS 6,648,187 B1 11/2003 Shypkowski
7,793,690 B2 9/2010 Voglewede et al.
8,166,704 B1 * 5/2012 Sydlowski ..... A01G 27/005 47/48.5
9,567,201 B2 2/2017 Seo et al.
9,568,240 B2 2/2017 Hall et al.
2008/0184730 A1 * 8/2008 Voglewede ..... F25D 23/126 62/389
2010/0307184 A1 * 12/2010 Jung ..... F25D 23/126 62/389
2015/0329347 A1 * 11/2015 Veldhi ..... F25D 23/126 141/1
2015/0336786 A1 11/2015 Gardner et al.
2016/0370100 A1 12/2016 Kim
2017/0051963 A1 * 2/2017 Root ..... B67D 1/0888

FOREIGN PATENT DOCUMENTS

GB 2371539 B 7/2002

* cited by examiner

*Primary Examiner* — Elizabeth J Martin
(74) *Attorney, Agent, or Firm* — Dority & Manning, P.A.

(57) ABSTRACT

A refrigerator appliance includes a dispensing assembly mounted to a dispenser recess for providing a flow of water. The dispensing assembly includes a flexible hose that is movable between an extended position and a retracted position and a retraction mechanism for urging the flexible hose toward the retracted position. A dispensing nozzle is fluidly coupled to an end of the flexible hose and is mounted to an external container by a mechanical clip. The flow of water may be activated by a button or voice activation system.

17 Claims, 5 Drawing Sheets

DISPENSING ASSEMBLY FOR A REFRIGERATOR APPLIANCE

FIELD OF THE INVENTION

The present subject matter relates generally to refrigerator appliances, and more particularly to dispensing assemblies for refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). Further, refrigerator appliances commonly include dispensing assemblies for providing ice or water into external containers. For example, such dispensing assemblies are commonly mounted within a dispenser recess on a front of a door of the refrigerator appliance at a height convenient for user access.

However, users may frequently wish to fill containers that cannot fit within the dispensing assembly or door recess, or which are otherwise positioned remotely from the dispensing assembly. For example, a user may wish to fill a pitcher or large container positioned on the floor. Using a dispensing assembly fixed on the door and having a fixed dispensing nozzle would not permit filling such a container. Even if a dispensing nozzle were able to fill such a container, a user would need to hold the nozzle close to the floor and might not be able to reach the dispensing assembly or control panel for starting and stopping the flow of water.

Accordingly, a refrigerator appliance with features for improving the dispensing of ice or water would be desirable. More particularly, a dispensing assembly for a refrigerator appliance that facilitates convenient filling of containers that are remote from the door of the refrigerator appliance would be particularly beneficial.

BRIEF DESCRIPTION OF THE INVENTION

The present subject matter provides a refrigerator appliance including a dispensing assembly mounted to a dispenser recess for providing a flow of water. The dispensing assembly includes a flexible hose that is movable between an extended position and a retracted position and a retraction mechanism for urging the flexible hose toward the retracted position. A dispensing nozzle is fluidly coupled to an end of the flexible hose and is mounted to an external container by a mechanical clip. The flow of water may be activated by a button or voice activation system. Additional aspects and advantages of the invention will be set forth in part in the following description, or may be apparent from the description, or may be learned through practice of the invention.

In a first exemplary embodiment, a refrigerator appliance defining a vertical direction, a lateral direction, and a transverse direction is provided. The refrigerator appliance includes a cabinet defining a chilled chamber and a door being rotatably hinged to the cabinet to provide selective access to the chilled chamber, the door defining a dispenser recess. A dispensing assembly is mounted to the dispenser recess for providing a flow of water. The dispensing assembly includes a flexible hose extending between a water supply and the dispenser recess, the flexible hose being movable between an extended position and a retracted position. A retraction mechanism is operably coupled to the flexible hose for urging the flexible hose toward the retracted position and a dispensing nozzle fluidly coupled to the flexible hose for selectively dispensing water from the water supply.

According to another exemplary embodiment, a dispensing assembly mounted to a dispenser recess of a refrigerator appliance for providing a flow of water is provided. The dispensing assembly includes a flexible hose extending between a water supply and the dispenser recess, the flexible hose being movable between an extended position and a retracted position. A retraction mechanism is operably coupled to the flexible hose for urging the flexible hose toward the retracted position. A dispensing nozzle is fluidly coupled to the flexible hose for selectively dispensing water from the water supply and a support member extends from the flexible hose or the dispensing nozzle to support the dispensing nozzle while filling a container.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
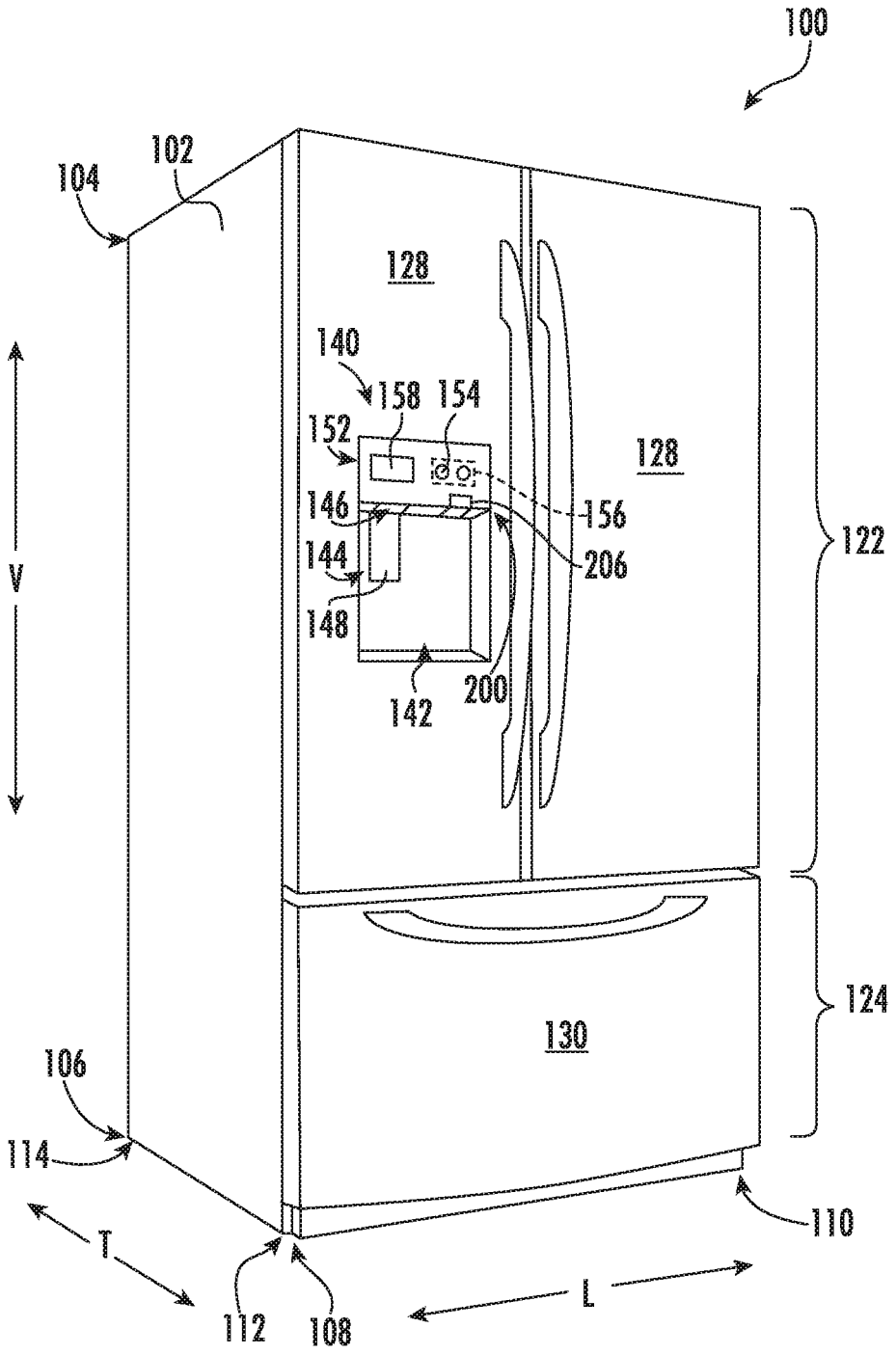
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
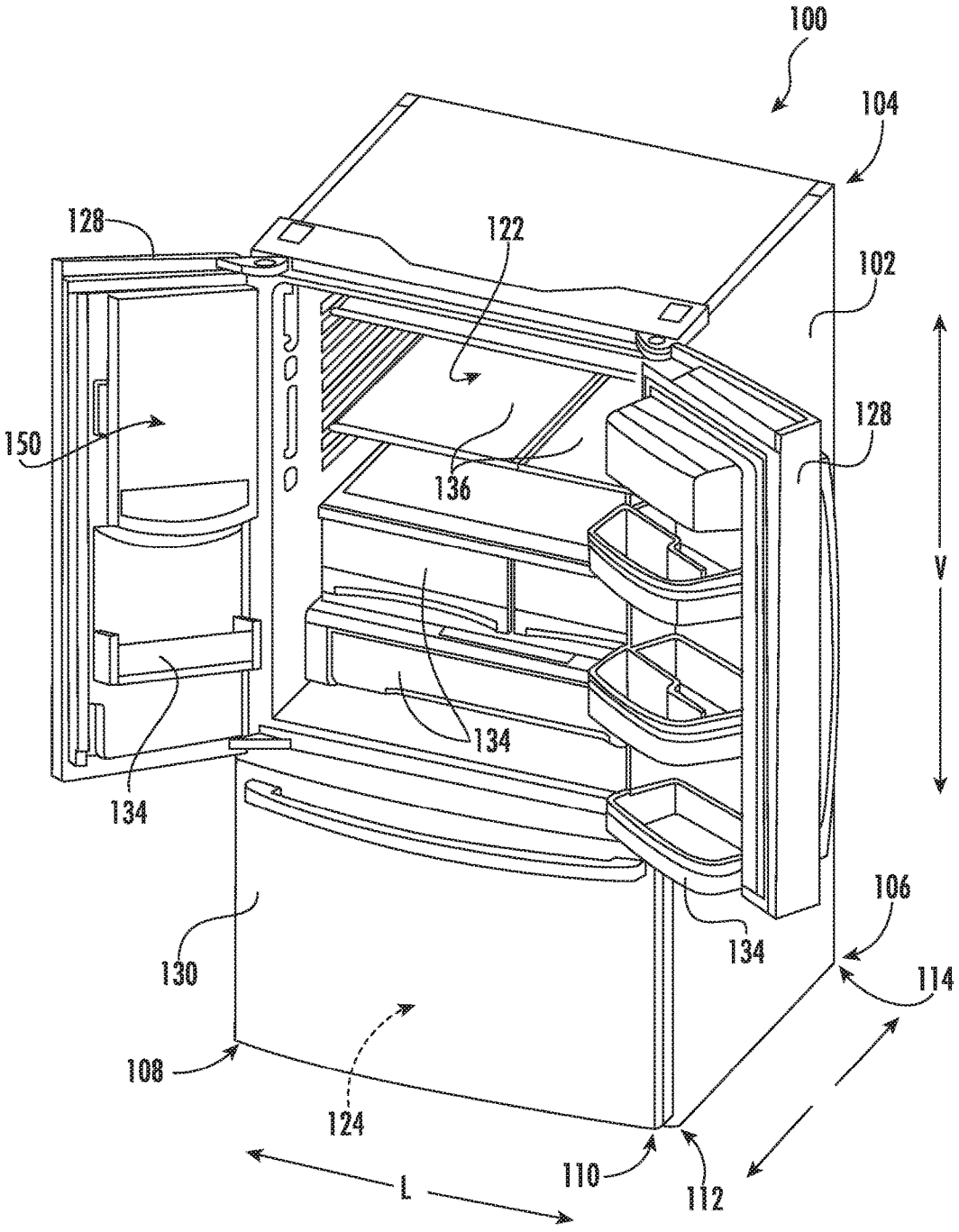
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIGS. 1 through 5, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Figure 3:
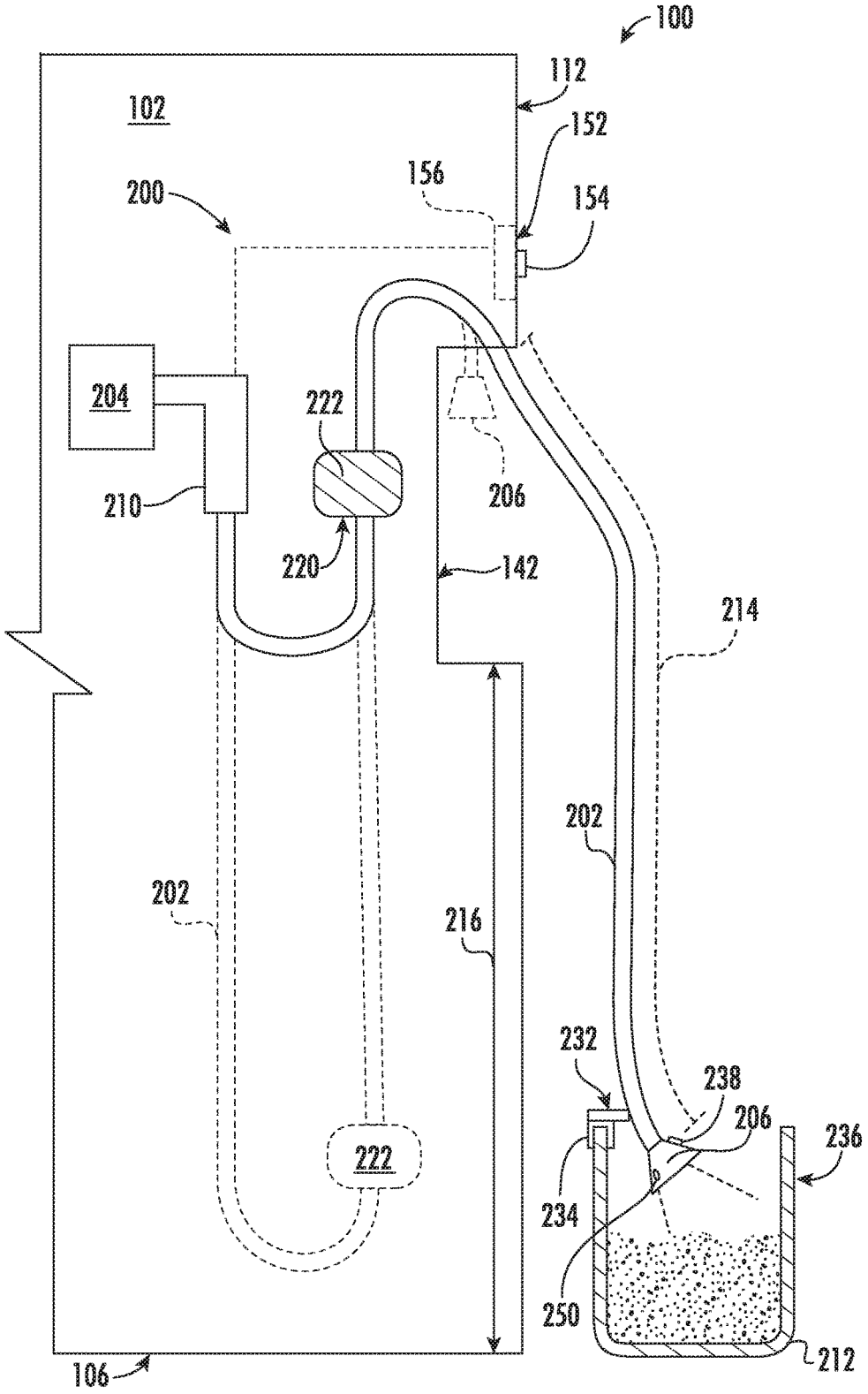
FIG. 3 provides a schematic view of a dispensing assembly for use with the exemplary refrigerator appliance of FIG. 1 according to an exemplary embodiment of the present subject matter.
Figure 4:
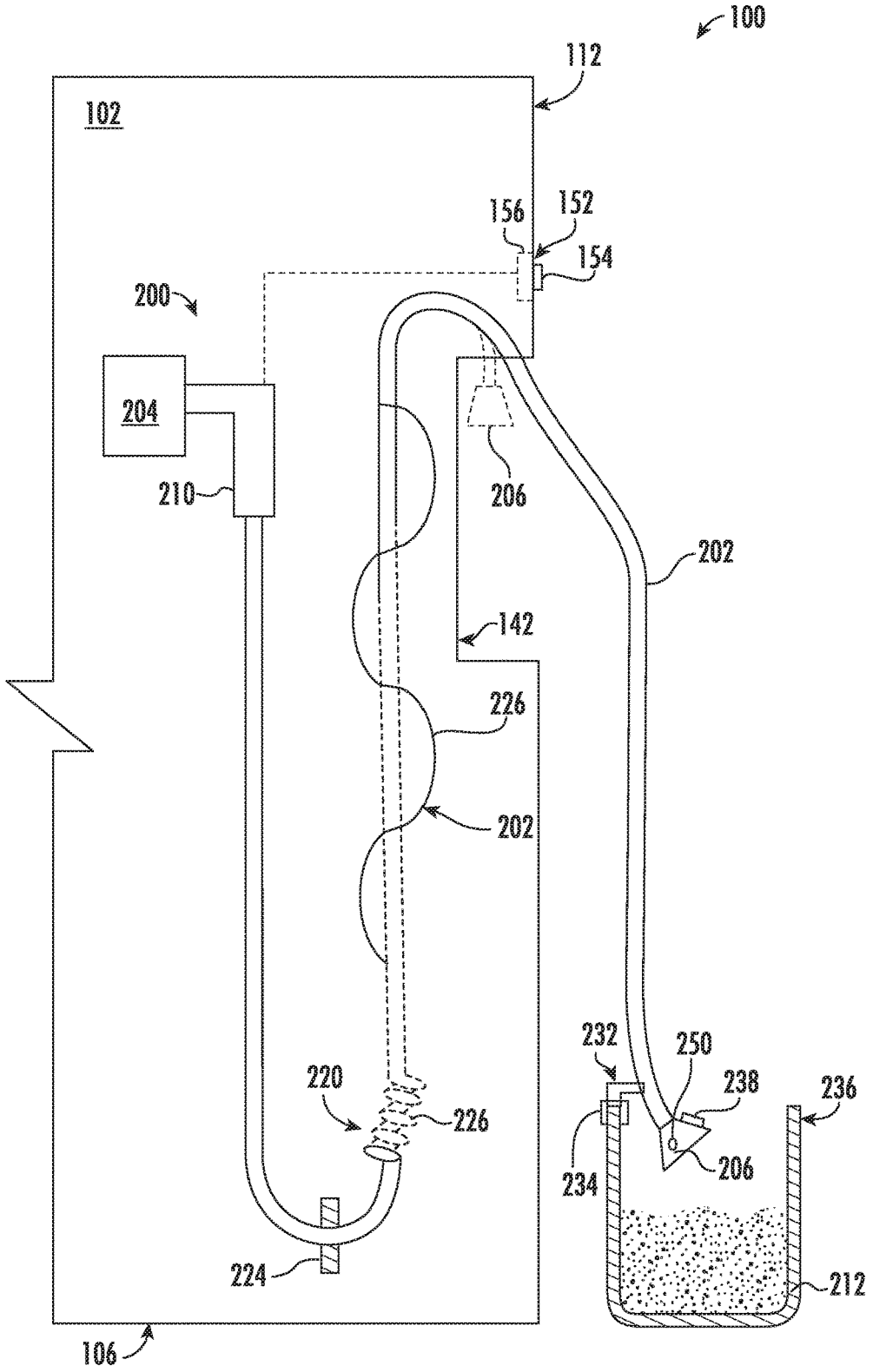
FIG. 4 provides a schematic view of a dispensing assembly for use with the exemplary refrigerator appliance of FIG. 1 according to another exemplary embodiment of the present subject matter.
Figure 5:
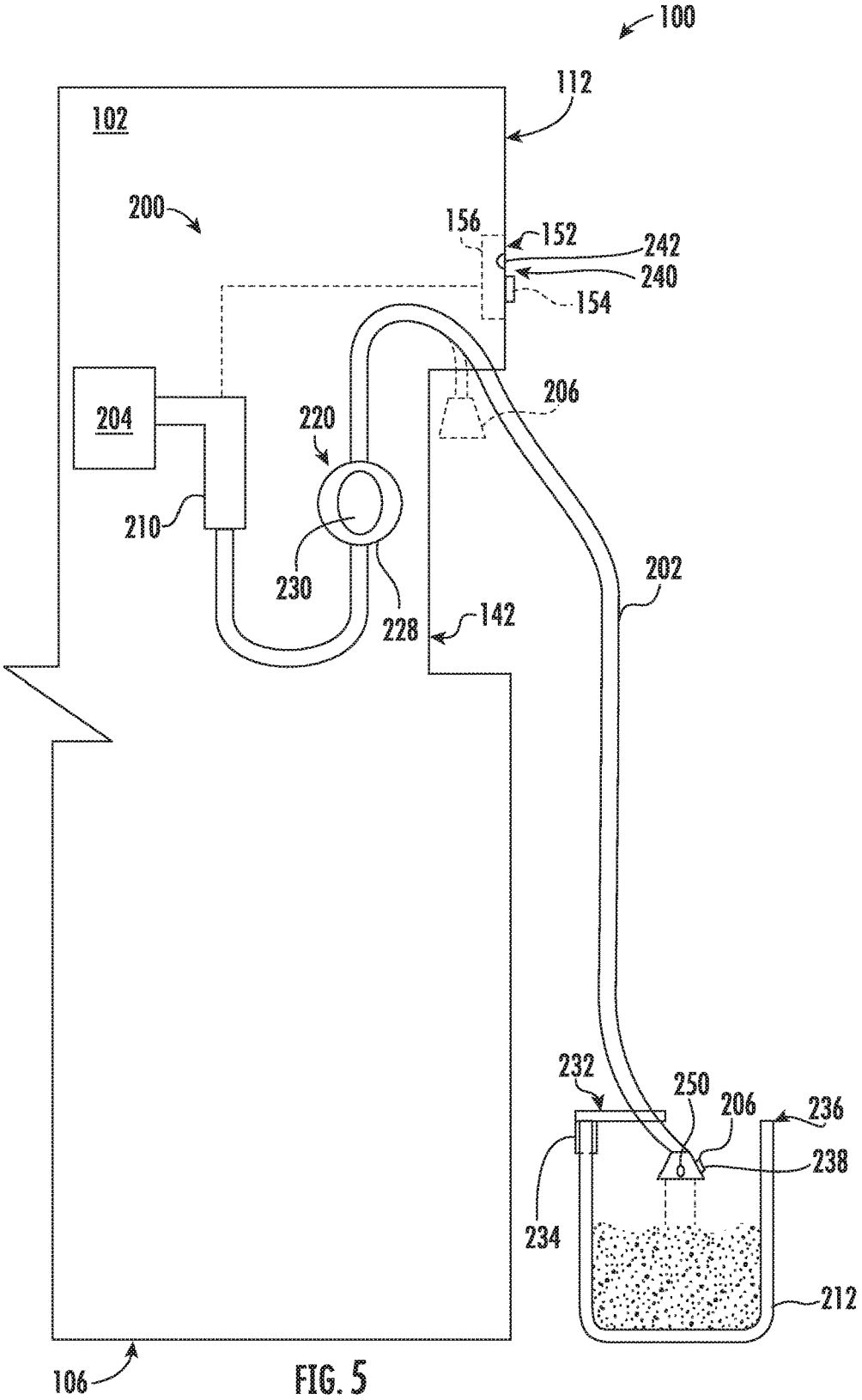
FIG. 5 provides a schematic view of a dispensing assembly for use with the exemplary refrigerator appliance of FIG. 1 according to another exemplary embodiment of the present subject matter.

As best illustrated in FIGS. 3 through 5, dispensing assembly 140 further includes features for dispensing water at dispenser recess 142 or at a location remote from dispenser recess 142. Specifically, dispensing assembly 140 includes a water dispenser 200 including a flexible hose 202 extending between a water supply 204 and dispenser recess 142. According to the illustrated embodiment, water supply 204 may be any fluid supply, such as an external supply conduit fluidly coupled to refrigerator appliance 100. In addition, water supply 204 may provide filtered or unfiltered water from a location within cabinet 102 or within refrigerator door 128.

As illustrated, a dispensing nozzle 206 is fluidly coupled to an end of flexible hose 202. In addition, flexible hose 202 is fluidly coupled to water supply 204 through a valve assembly 210. Valve assembly 210 is generally configured for regulating the flow of water from water supply 204 through flexible hose 202. In this regard, valve assembly 210 is an operative communication with controller 156 for receiving commands regarding the dispensing of water through flexible hose 202. Dispensing nozzle 206 may be fluidly coupled at an opposite end of flexible hose 202 for selectively dispensing and directing the flow of water.

According to the illustrated embodiment, valve assembly 210 is positioned within cabinet 102 for regulating the flow of water through flexible hose 202. However, it should be appreciated that according to alternative embodiments valve assembly 210 or another flow regulating means can be positioned at any other suitable location for controlling the flow of water through flexible hose 202 or out of dispensing nozzle 206. For example, according to an alternative embodiment, valve assembly 210 could instead be positioned within dispensing nozzle 206 for regulating the flow of water at an outlet of flexible hose 202. Alternatively, water supply 204 and valve assembly 210 could be positioned at any other suitable location within refrigerator appliance 100.

Moreover, flexible hose 202 is movable between an extended position and a retracted position. As illustrated in the figures, the extended position is generally shown with solid lines, while the retracted positioned is identified using dashed lines. In this regard, flexible hose 202 may be pulled out of dispenser recess 142 to an extended position such that a user may dispense water at a location remote from dispenser recess 142. More specifically, according to the illustrated embodiment, flexible hose 202 is long enough to be pulled out to fill a container 212 that is positioned on the ground, i.e., proximate a bottom 106 of refrigerator appliance 100. In this regard, as shown in FIG. 3, flexible hose 202 may define an extension length (as identified generally by dotted line 214) between the extended and the retracted position. According to an exemplary embodiment, the extension length 214 is greater than a height 216 defined between dispenser recess 142 and bottom 106 of refrigerator appliance 100 along the vertical direction V. according still other embodiments, extension length 214 may be any suitable length for dispensing water to any other suitable location.

Moreover, dispensing assembly 140 includes a retraction mechanism 220 operably coupled to flexible hose 202 for urging flexible hose 202 toward the retracted position. In this manner, retraction mechanism 220 may be any suitable feature or mechanism configured for drawing flexible hose 202 back into dispenser recess 142, refrigerator door 128, or cabinet 102. Retraction mechanism 220 may retract flexible hose 202 when the dispensing process is finished or when a user wishes to dispense water into a container such as a cup positioned within dispenser recess 142. FIGS. 3 through 5 illustrate three exemplary embodiments of retraction mechanism 220 which may be used for retracting flexible hose 202. Although three exemplary retraction mechanisms 220 are described below for illustrating aspects of the present subject matter, it should be appreciated that other suitable mechanisms are possible and within the scope of the present subject matter.

More specifically, referring to FIG. 3, retraction mechanism 220 is a weighted loop. In this regard, flexible hose 202 may be a fixed length of hose positioned within cabinet 102 in the retracted position. A weight 222 is mounted on a bottom of the loop of flexible hose 202 within cabinet 102. As a user pulls dispensing nozzle 206 to the desired location, weight 222 is moved vertically within cabinet 102. When a user releases dispensing nozzle 206, weight 222 urges flexible hose 202 into the retracted position under the force of gravity.

Alternatively, as illustrated in FIG. 4, retraction mechanism 220 is a resilient coil that generally urges flexible hose 202 into a retracted position and dispensing nozzle 206 back toward a seated position within dispenser recess 142. Specifically, flexible hose 202 is fixed along the vertical direction by a positioning clip 224 proximate a bottom 106 of cabinet 102. Although clip 224 is illustrated at bottom 106 of cabinet 102, it should be appreciated that clip 224 could alternatively be placed at any other suitable location within cabinet 102. In the retracted position, a coiled portion 226 of flexible hose 202 is tightly coiled in a retracted position and dispensing nozzle 206 is seated in dispenser recess 142. In operation, a user may pull on dispensing nozzle 206 such that coiled portion 226 is extended to permit a user to dispense water where desired. After the user is finished using dispensing nozzle 206 for providing water into container 112, the user may release dispensing nozzle 206 and the resiliency in coiled portion 226 and flexible hose 202 may draw flexible hose 202 back into cabinet 102 and into the retracted position. However, according to alternative embodiments, a mechanical spring may be attached to a fixed location within cabinet 102 and to flexible hose 202 for urging flexible hose 202 toward the retracted position.

According to still another embodiment illustrated in FIG. 5, retraction mechanism 220 may be a coiling or winding mechanism 228 which includes a spool for winding flexible hose 202 in the retracted position. Winding mechanism 228 may urge flexible hose 202 into the retracted position under the force of a torsional spring (e.g., such as commonly used in a tape measure) or may be driven by an electric motor 230 (such as illustrated in FIG. 5). Other mechanisms and methods for retracting flexible hose 202 are possible and within the scope of the present subject matter. For example, a linear spring, a ratcheting mechanism, or any other suitable means for retracting flexible hose 202 may be used according to alternative embodiments.

Dispensing assembly 140 may include additional features for securing dispensing nozzle 206 onto container 212 or at a fixed position relative to container 212. In this regard, for example, dispensing assembly 140 may include a support member 232 that extends from flexible hose 202 or dispensing nozzle 206 to support dispensing nozzle 206 while filling container 212. Notably, support member 232 permits a user to fix the position of dispensing nozzle 206 relative to container 212, such that they may begin a dispensing process and walk away or remove their hands from dispensing nozzle 206 without the risk of water dispensing outside container 212. According to the illustrated embodiment, support member 232 includes a mechanical clip 234 such as an alligator clip or a visor clip which attaches directly to a lip 236 of container 212.

Dispensing assembly 140 may include various means for controlling the dispensing of water by a user. In this regard, for example, dispensing assembly 140 may include a button, such as an input 154 positioned on control panel 152 or a dedicated button 238 mounted directly on dispensing nozzle 206. In this manner, a user may activate and selectively dispense water from water dispenser 200 at control panel 152 and/or at dispensing nozzle 206. Notably, the ability to dispense water using a button 238 on dispensing nozzle 206 is advantageous because a user may already be positioned at a container 212 located remote from control panel 152 and may not be able to reach control panel 152. Thus, button 238 permits a user to quickly and conveniently control the flow of water out dispensing nozzle 206.

According to still another embodiment illustrated in FIG. 5, dispensing assembly 140 may include a voice activation system 240 for receiving voice commands from a user regarding the dispensing of water. In this regard for example, voice activation system 240 may include a microphone 242 positioned on dispensing nozzle 206 or on front side 112 of refrigerator appliance 100 for receiving voice commands. Microphone 242 may be communicatively coupled with controller 156 which may receive and decipher commands and make appropriate control actions, e.g., through valve assembly 210. Thus, during operation, a user may position dispensing nozzle 206 over the container 212 to be filled and may state "dispense water," "stop water," "dispense three cups of water," etc. Controller 156 may then operate valve assembly 210 accordingly to achieve such functions.

Referring still to FIGS. 3 through 5, dispensing assembly 140 may further include additional features for determining the amount of water dispensed and/or regulating the flow of water to dispense a desired amount. In this regard, dispensing nozzle 206 may include a water level detection sensor 250 that is generally configured for detecting the level of water within container 212. For example, according to exemplary embodiments, water level detection sensor 250 may be an internal float, a proximity sensor, an optical sensor, or an ultrasonic sensor mounted directly to dispensing nozzle 206 for detecting a level of water. In addition, although water level detection sensor 250 is illustrated as a single sensor, it should be appreciated that water level detection sensor 250 could include any suitable number and type of sensors at any suitable positions.

Using water level detection sensor 250, controller 156 may regulate the flow of water in any suitable manner. For example, as a safety mechanism, controller 156 may operate according to an automatic shut off procedure, such that valve assembly 210 stops the flow of water any time water level detection sensor 250 detects that water within container 212 has reached dispensing nozzle 206. According to another embodiment, controller 156 may regulate valve assembly 210 to dispense a precise amount of water (e.g., a "precise fill" operation). In this regard, a user may specify a desired volume of water and valve assembly 210 may be controlled to dispense precisely that volume (e.g., 2 liters). Alternatively, controller 156 may be configured to fill container 212 to a percentage of the container volume (e.g., fill container to 50% volume). According to still another embodiment, controller 156 may regulate valve assembly 210 strictly according to the user control (e.g., "start" and "stop" fill commands or two presses of button). Other methods of regulating the flow of water in response to water level detection sensor 250 or independently of such sensors are possible and within the scope of the present subject matter.

As one skilled in the art will appreciate, the above described embodiments are used only for the purpose of explanation. Modifications and variations may be applied, other configurations may be used, and the resulting configurations may remain within the scope of the invention. For example, flexible hose 202 may be used to dispense ice and/or water, other retraction mechanisms may be used, and other control methods for dispensing water may be implemented. One skilled in the art will appreciate that such modification and variations may remain within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet defining a chilled chamber;

a door being rotatably hinged to the cabinet to provide selective access to the chilled chamber, the door defining a dispenser recess; and a dispensing assembly mounted to the dispenser recess for providing a flow of water, the dispensing assembly comprising:

a flexible hose extending between a water supply and the dispenser recess, the flexible hose being movable between an extended position and a retracted position;

a retraction mechanism operably coupled to the flexible hose for urging the flexible hose toward the retracted position, wherein the retraction mechanism is a weighted loop, a section of recoil tubing, or a ratcheting mechanism;

a dispensing nozzle fluidly coupled to the flexible hose for selectively dispensing water from the water supply; and a water level detection sensor mounted to the dispensing nozzle for detecting a water level within a container.

2. The refrigerator appliance of claim 1, wherein the flexible hose defines an extension length between the extended position and the retracted position, wherein the extension length is greater than a height between the dispenser recess and a bottom of the refrigerator appliance along the vertical direction.

3. The refrigerator appliance of claim 1, wherein the dispensing assembly further comprises:

a support member extending from the flexible hose or the dispensing nozzle to support the dispensing nozzle while filling a container.

4. The refrigerator appliance of claim 3, wherein the support member comprises a mechanical clip that attaches directly to the container.

5. The refrigerator appliance of claim 1, wherein the dispensing assembly further comprises:

a valve assembly for regulating the flow of water through the flexible hose and the dispensing nozzle; and a button that is operably coupled with the valve assembly, the dispensing nozzle being configured for dispensing water when the button is pressed.

6. The refrigerator appliance of claim 5, wherein the valve assembly is positioned within the dispensing nozzle or within the cabinet proximate the water supply.

7. The refrigerator appliance of claim 5, wherein the button is mounted on a control panel of the refrigerator appliance.

8. The refrigerator appliance of claim 5, wherein the button is located on the dispensing nozzle.

9. The refrigerator appliance of claim 1, wherein the dispensing assembly further comprises:

a valve assembly for regulating the flow of water through the flexible hose and the dispensing nozzle; and a voice activation system operably coupled with the valve assembly, the dispensing nozzle being configured for dispensing water in response to a user command received by the voice activation system.

10. The refrigerator appliance of claim 1, wherein the retraction mechanism is a winding mechanism driven by an electric motor.

11. The refrigerator appliance of claim 1, wherein the water level detection sensor is an internal float, a proximity sensor, or an optical sensor and is mounted directly to the dispensing nozzle.

12. The refrigerator appliance of claim 1, further comprising:

a controller configured for operating a valve assembly to selectively dispense water.

13. A dispensing assembly mounted to a dispenser recess of a refrigerator appliance for providing a flow of water, the dispensing assembly comprising:

a flexible hose extending between a water supply and the dispenser recess, the flexible hose being movable between an extended position and a retracted position;

a retraction mechanism operably coupled to the flexible hose for urging the flexible hose toward the retracted position, wherein the retraction mechanism is a weighted loop, a section of recoil tubing, or a ratcheting mechanism;

a dispensing nozzle fluidly coupled to the flexible hose for selectively dispensing water from the water supply;

a support member extending from the flexible hose or the dispensing nozzle to support the dispensing nozzle while filling a container; and a water level detection sensor mounted to the dispensing nozzle for detecting a water level within the container.

14. The dispensing assembly of claim 13, wherein the flexible hose defines an extension length between the extended position and the retracted position, wherein the extension length is greater than a height between the dispenser recess and a bottom of the refrigerator appliance along a vertical direction.

15. The dispensing assembly of claim 13, wherein the support member comprises a mechanical clip that attaches directly to the container.

16. The dispensing assembly of claim 13, wherein the dispensing assembly further comprises:

a valve assembly for regulating the flow of water through the flexible hose and the dispensing nozzle; and a button that is operably coupled with the valve assembly, the dispensing nozzle being configured for dispensing water when the button is pressed.

17. The dispensing assembly of claim 13, wherein the dispensing assembly further comprises:

a valve assembly for regulating the flow of water through the flexible hose and the dispensing nozzle; and a voice activation system operably coupled with the valve assembly, the dispensing nozzle being configured for dispensing water in response to a user command received by the voice activation system.

* * * * *